United States Patent [19]

Jones

[11] Patent Number: 5,033,746

[45] Date of Patent: Jul. 23, 1991

[54] GOLF CLUB BALL-IMPACT MARKER

[76] Inventor: Michael D. Jones, 500 Northside Cr. N.W. V-2, Atlanta, Ga. 30309

[21] Appl. No.: 549,823

[22] Filed: Jul. 9, 1990

[51] Int. Cl.[5] ..... A63B 69/36

[52] U.S. Cl. ..... 273/186 D; 273/26 B

[58] Field of Search ..... 273/186 D, 186 R, 186 C, 273/183 D, 26 R, 26 B, 29 A

[56] References Cited

U.S. PATENT DOCUMENTS

| | | | |
|---|---|---|---|
| 2,660,436 | 11/1953 | Grossman | 273/186 D |
| 3,071,379 | 1/1963 | Ramsey | 273/186 D |
| 3,754,764 | 8/1973 | Manheck | 273/186 D |
| 4,676,508 | 6/1987 | Dilny | 273/186 D |
| 4,974,851 | 12/1990 | Closser et al. | 273/186 D |

*Primary Examiner*—George J. Marlo

[57] ABSTRACT

A device for marking the point of impact of a golf ball on the face of a golf club. The marker (8) is comprised of an outer translucent sheet (10) which adheres to an underlying sheet (18) in areas where pressure is applied such as that resulting from the impact color of the underlying sheet (18) is visible through the translucent outer sheet (10), thus producing a visible indication of the point of outer translucent sheet (10) and thus breaking the adherence between it and the underlying sheet (18). The marker is attached to the face of a golf club by a layer of adhesive (20) on the back of the marker. This layer of adhesive is covered by the protective sheet (22) prior to installation of the device. A pressure-sensitive adhesive coating (29) enables the sheet (10) to adhere to the sheet 18.

3 Claims, 2 Drawing Sheets

GOLF CLUB BALL-IMPACT MARKER

BACKGROUND—FIELD OF INVENTION

This invention relates to methods and devices for marking the point of impact of a golf ball on the face of a golf club head.

BACKGROUND—DESCRIPTION OF PRIOR ART

Heretofore, devices developed for marking the point of impact of a ball on the face of a golf club head have been either difficult to use or fail to produce a distinct mark after each shot. Manheck U.S. Pat. No. 3,754,764 (1973) discloses an impact marker comprising an imaging sheet material containing minute rupturable capsules, commonly referred to as "carbonless paper", which creates a colored mark in the impact area. The marks on this type of paper are permanent; therefore, after a few shots, it is difficult or impossible to distinguish the current mark from marks made by previous shots.

Dilny U.S. Pat. No. 4,676,508 (1987) discloses a method and apparatus for marking the point of impact of a golf ball comprising a coating on the golf ball which is deposited on the club face at the point of impact. This method is difficult to use because it requires that the coating be applied to each ball hit. Also, it may be necessary to remove any laminate or varnish from the face of the club before using this method.

OBJECTS AND ADVANTAGES

Accordingly, several objects and advantages of the present invention are:

(a) to provide an impact marker which produces a distinguishable indication of the point of impact of the golf ball;

(b) to provide an impact marker which allows the mark to be easily erased after each shot, thus obviating the problem of distinguishing the mark for the current shot from the marks made by previous shots;

(c) to provide an impact marker which is reusable for may shots;

(d) to provide an impact marker which is easy to use;

(e) to provide an impact marker which is lightweight and does not interfere with the user's golf swing;

(f) to provide an impact marker which is cheap to manufacture;

(g) to provide an impact marker which does not require modifications to the golf ball or to the club head to which the marker is attached;

Further objects and advantages will become apparent from a consideration of the ensuing description and drawings.

DRAWING FIGURES

REFERENCE NUMERALS IN DRAWINGS

8—entire impact marker

10—outer translucent sheet of impact marker

12—lower part of translucent sheet used as a tab for lifting

14—permanent adhesive strip used to attach translucent sheet to underlying sheet 16—releasable adhesive strip used to fasten bottom of translucent sheet to underlying sheet 18—underlying sheet to which translucent sheet adheres 20—adhesive layer for attaching marker to club head face 22—sheet covering adhesive layer until installation of marker 24—entire club head 26—club head face 28—impact mark created on marker by golf ball

DEFINITIONS

A few terms used in the description of the invention may need clarification for this context.

strong adhesive—an adhesive used to attach two surfaces which will never need to be separated without damaging one or both of the surfaces.

releasable adhesive—an adhesive used to attach two surfaces which must be easily separated without damaging either of the surfaces.

shot—the act of hitting a golf ball with the face of a golf club.

DESCRIPTION OF INVENTION

Figure 1:
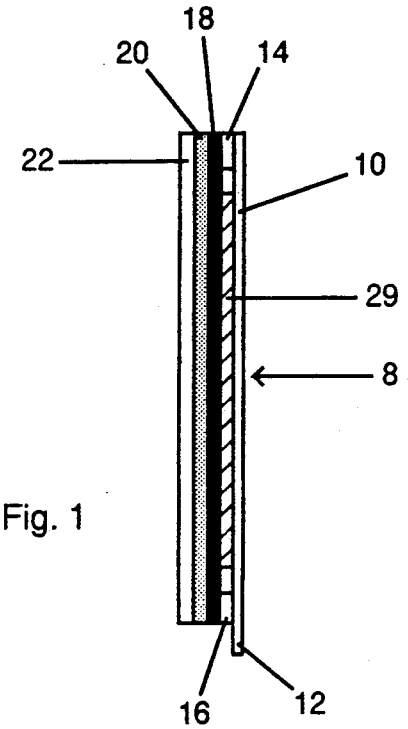
FIG. 1 shows a cross section of an impact marker. The thickness of the marker is greatly exaggerated in order to show the individual layers of the device.

A possible embodiment of the impact marker of the present invention is illustrated in FIG. 1 which shows a cross section of a marker. An outer translucent sheet 10 overlays an inner sheet 18. These two sheets comprise the method for creating the actual image of the impact mark on the club face. These two sheets may be constructed of any materials which satisfy the following properties when the materials are in contact:

(a) The outer sheet 10 adheres to the inner sheet 18 to a greater degree in areas where pressure is applied than in areas of light contact.

(b) The color of the inner sheet 18 is visible through the outer sheet 10 to a greater degree in areas of adherence between the two sheets than in areas of no adherence or lesser adherence.

(c) The pressure-sensitive adherence described in (a) must be releasable without substantially damaging the surface of either sheet.

(d) One surface of either the outer sheet 10, or the inner sheet 18, or both, is coated with the pressure sensitive, releasable adhesive 29.

Many combinations of materials exhibit the properties described above. One possible combination of materials is that which can be found in toy drawing tablets such as the one sold under the trademark "MAGIC SLATE" by Western Publishing Company, Inc., Racine, Wis. This tablet contains an inner sheet of black cardboard coated with wax and an outer sheet of translucent white plastic film. When pressure is applied to the surface of the outer sheet, it sticks to the wax coating of the inner sheet. In the areas of this adherence, the black inner sheet is visible through the outer translucent sheet, creating distinct marks on the slate. Lifting the outer sheet breaks the adherence and removes the marks. Any releasable adhesive could be substituted for the wax on the inner sheet.

Another possible combination of materials would be translucent, pressure-sensitive adhesive tape for the outer sheet 10 and colored cardboard for the inner sheet 18. In contrast to the previous materials, this combination contains an adhesive on the surface of the outer sheet 10 instead of the inner sheet 18.

Thus, when a golf impacts the surface of the outer sheet 10, the outer sheet 10 adheres to the inner sheet 18. A visible mark 28 is created in this area of adherence due to the visibility of the color of the inner sheet 18 through the outer sheet 10. The top edge of the outer sheet 10 is attached to the inner sheet 18 by a thin strip of strong adhesive 14. The bottom of the outer sheet 10 is attached to the inner sheet 18 by a thin strip of releasable adhesive 16. This adhesive strip 16 is used to keep the outer sheet 10 in place during the golf swing. The adherence of this adhesive strip 16 is broken by lifting the bottom edge 12 of the outer sheet 10, thus separating the outer sheet 10 from the inner sheet 18. When the outer sheet 10 and the inner sheet 18 are separated after a shot, the area of adherence between the two sheets is broken, and thus the impact mark is erased.

The back of the inner sheet 18 is coated with a strong adhesive 20 which allows the impact marker 8 to be attached to the club head 24. This layer of adhesive 20 is covered with a protective sheet 22 until the impact marker 8 is installed on the club head face. This protective sheet 22 is constructed of wax-coated paper or any other material which can be easily removed without disturbing the adhesive.

Figure 2:
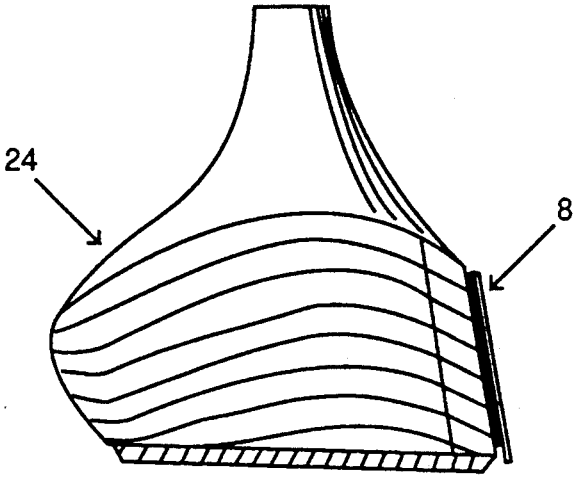
FIG. 2 shows a front view of a golf club head with an impact marker installed.
Figure 3:
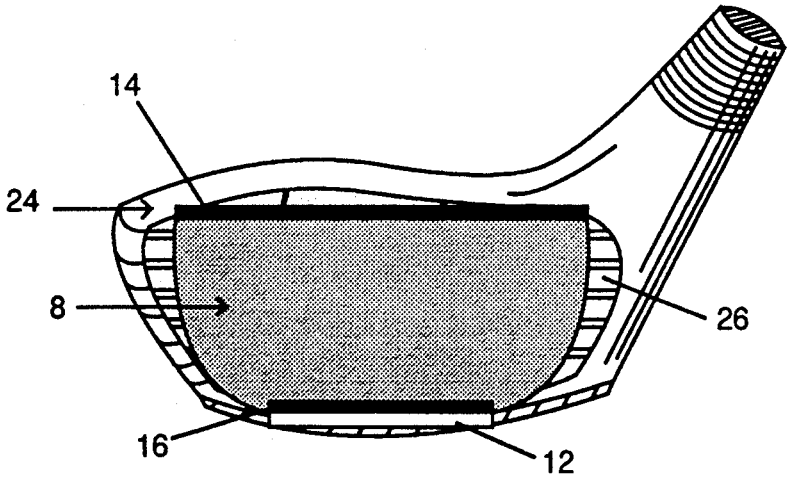
FIG. 3 shows the face side of a club head with an impact marker installed before a mark is produced by a gold ball.
Figure 4:
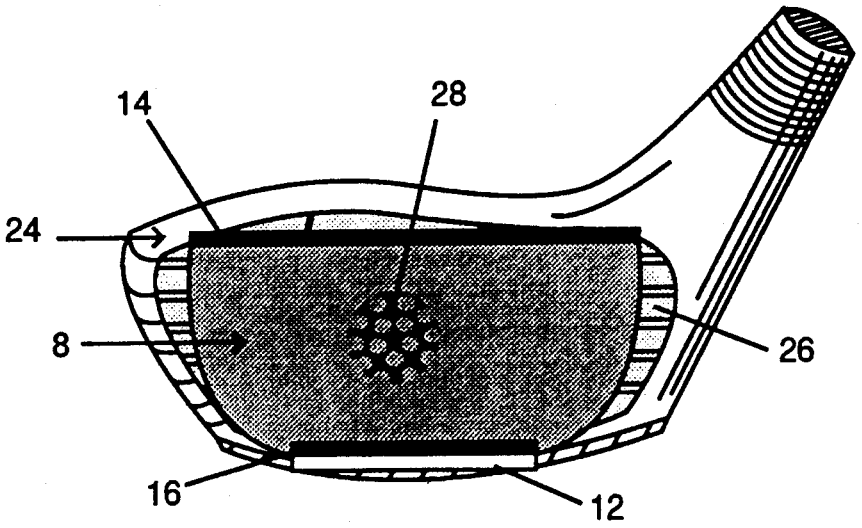
FIG. 4 shows the face side of a club head with an impact marker installed after a mark has been produced by a golf ball.
Figure 5:
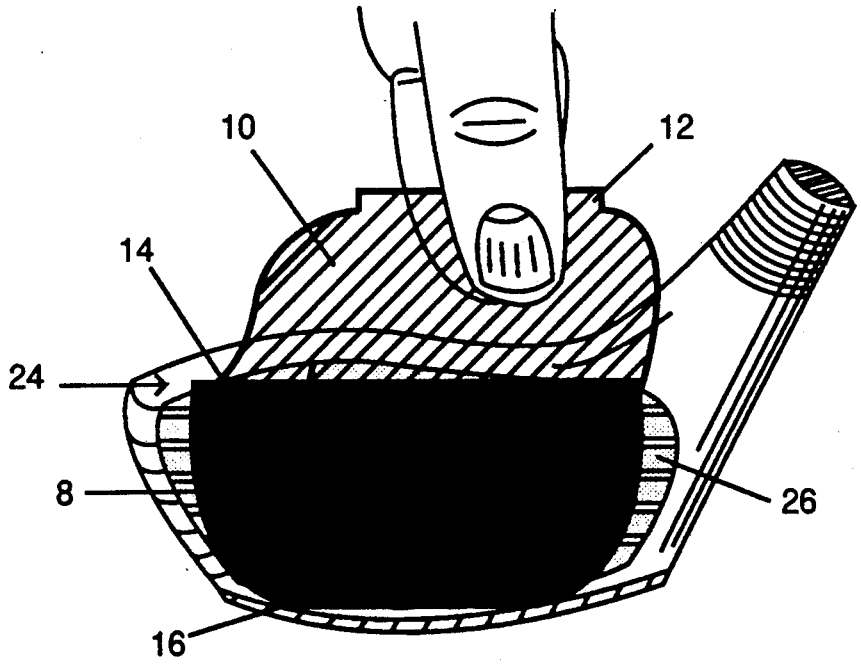
FIG. 5 shows the process of erasing the impact mark by lifting the outer translucent layer of the marker.

As shown in FIG. 2 and FIG. 3, the impact marker 8 is attached to the club head face 26 by the adhesive layer 20. The impact marker 8 can be manufactured in any size or shape which will cover a substantial part of the club head face 26. When a golf ball strikes the surface of the outer sheet 10 of the impact marker 8, the outer sheet 10 adheres to the inner sheet 18 in the area of impact and creates an image 28 on the marker 8 as described above and shown in FIG. 4. As shown in FIG. 5, this image 28 is removed from the marker 8 by lifting the overhanging edge 12 of the outer sheet 10 until the outer sheet 10 is separated from the inner sheet 18. The outer sheet 10 is then placed back on top of the inner sheet 18 and slight pressure is applied to the bottom edge in the area of the adhesive strip 16. The impact marker is then ready for the next shot.

SUMMARY, RAMIFICATIONS, AND SCOPE

Accordingly, the reader will see that the golf ball impact marker of this invention can be used to determine the exact point of impact of a golf ball on the club head face. By examining the marker after each shot, the user can adjust his swing so that the point of impact occurs at the optimum location on the club face. The impact marks can be easily erased from the device by lifting the outer translucent sheet, thus allowing a single distinct mark to be produced with each shot. The marker is lightweight and does not require any modifications to the golf balls being used. The marker is constructed of common materials which can be easily acquired and is thus cheap to manufacture.

Although the above description discusses several possible embodiments of the invention, these should not be construed as limiting the scope of the invention, but as merely providing illustrations of some of the presently preferred embodiments. For example, the marker could be cut in any shape which covers a substantial area of an area of an average golf club face. The outer translucent sheet 10 and the underlying sheet 18 can be constructed of any materials which exhibit the properties described above and can be of any colors. The releasable adhesive strip 16 that is used to hold down the outer sheet 10 during the swing is not absolutely necessary. If the adhesion between the two sheets is strong enough, the user can simply apply pressure to the bottom edge of the marker before each shot. Many other modifications to the embodiments described here are possible.

Thus the scope of the invention should be determined by the appended claims and their legal equivalents, rather than by the specific embodiments described.

I claim:

1. A device for marking the point of impact of a golf ball on the face of a golf club, said device comprising:

a a first sheet of translucent material of any color overlaying a second sheet of material of a contrasting color, one or both of said first and second sheets having a coating of a releasable pressure-sensitive adhesive on one surface which is in contact with the other sheet such that said adhesive enables the first sheet to adhere to the second sheet where pressure is applied to said first sheet such as that created by the impact of a golf ball and such that the color of said second sheet is more visible through said translucent first sheet in areas of said adherence than in areas of no adherence or lighter adherence, b said first and second sheets being permanently attached along one edge and being separable by lifting an unattached edge of said first sheet in a direction generally perpendicular to the plane of the two sheets, such separation causing said areas of adherence created by the application of pressure on the marker to be completely removed, thus providing a means for erasing the mark created at the point of impact of a golf ball, c said second having a coating of pressure-sensitive adhesive distributed over the surface opposite the surface which is in contact with said first sheet, said layer of adhesive being overlayed by a third sheet of material, said adhesive being adhered to said third sheet such that said third sheet is easily removable allowing the attachment of the adhesive-covered surface of said second sheet of the device to the face of a golf club.

2. The device of claim 1 wherein said first and second sheets are cut to a size and shape sufficient to cover substantial area of a golf club face.

3. The device of claim 1 wherein said first sheet slightly overlaps said second sheet along the edge opposite the edge on which the two sheets are permanently attached, thus providing a tab for lifting the outer sheet in a direction generally perpendicular to the marker, thus separating the two sheets and removing areas of adherence between the two sheets.

* * * * *